250-506.1
5/10/83 XR $$$ SR
4,382,512

United States Patent [19]
Furminger

[11] 4,382,512
[45] May 10, 1983

[54] CONTAINER SYSTEM FOR DANGEROUS MATERIALS

[75] Inventor: Ronald J. Furminger, Amersham, England

[73] Assignee: The Radiochemical Centre Ltd., Amersham, England

[21] Appl. No.: 124,240

[22] Filed: Feb. 25, 1980

[30] Foreign Application Priority Data

Aug. 6, 1979 [GB] United Kingdom ..... 7927387

[51] Int. Cl.[3] ..... B65D 85/84; G21F 5/00
[52] U.S. Cl. ..... 206/446; 206/527; 206/565; 250/506.1; 250/507.1; 220/284
[58] Field of Search ..... 215/10, 12 R, 13 R, 215/295, 296, 302, 303; 206/527, 446, 488, 565; 220/23.83, 23.86, 69, 284, 256, 4 D; 53/492, 381 A; 250/506, 507

[56] References Cited

U.S. PATENT DOCUMENTS

| | | | |
|---|---|---|---|
| 968,216 | 8/1910 | Wettergreen | 215/12 R |
| 2,724,849 | 11/1955 | Schultz | 215/302 |
| 2,915,640 | 12/1959 | Grubel | 250/507 |
| 3,120,319 | 2/1964 | Buddrus | 215/13 R |
| 3,128,882 | 4/1964 | Kardulas | 206/446 |
| 3,256,441 | 6/1966 | Grasty | 250/506 |
| 3,308,980 | 3/1967 | Taylor | 215/12 R |
| 3,313,919 | 4/1967 | Richardson | 220/69 |
| 3,841,513 | 10/1974 | O'Connor | 215/215 |

FOREIGN PATENT DOCUMENTS

| | | | |
|---|---|---|---|
| 2241649 | 3/1973 | Fed. Rep. of Germany | 215/296 |
| 1176501 | 11/1958 | France | 53/381 A |
| 2369976 | 7/1978 | France | 215/296 |
| 275953 | 10/1964 | Netherlands | 220/23.83 |

*Primary Examiner*—Herbert F. Ross
*Attorney, Agent, or Firm*—Wenderoth, Lind & Ponack

[57] ABSTRACT

A container system comprising an outer container containing a glass or plastics vial wherein the latter is to be opened without the danger of injury to the operator due to spillage from the vial. The outer container has a screw-top lid which has an engaging cavity whereby, once unscrewed from the container, it may be engaged with the top of the vial itself (which is revealed when the lid is unscrewed) and manipulated to remove the vial top in safety.

10 Claims, 6 Drawing Figures

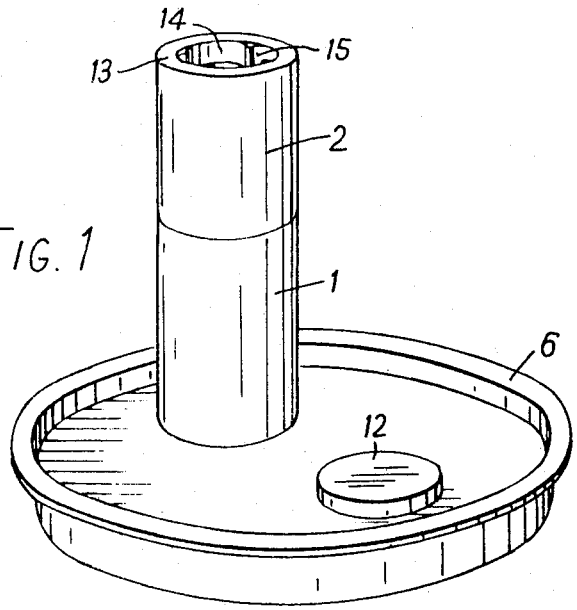
FIG. 1
FIG. 2
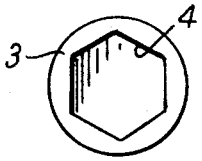
FIG. 3
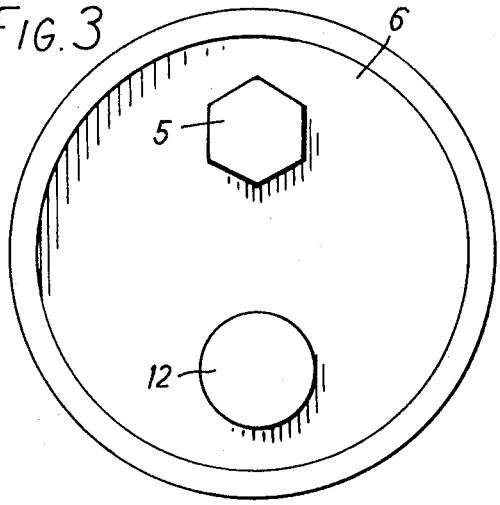
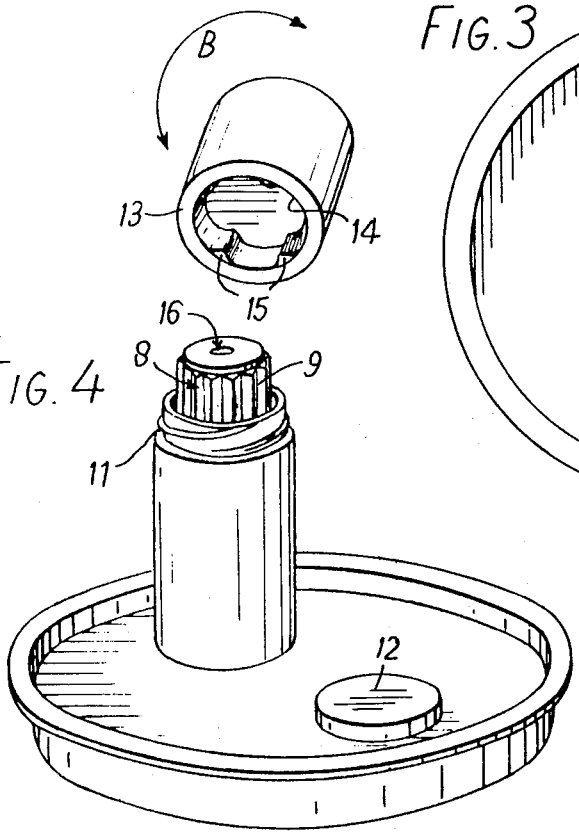
FIG. 4

A
8
11
12
C
8
9
D
11

7
17
10
12

CONTAINER SYSTEM FOR DANGEROUS MATERIALS

BACKGROUND OF THE INVENTION

This invention relates to a container system for storing and handling dangerous or harmful substances. The invention is particularly, although not exclusively, concerned with the storing and handling of radioactive liquids used in industry and in research.

The particular object of the invention is to provide a container system which enables such substances to be removed therefrom in comparative safety by instructing an operator to go through a set sequence of operations each time the container is opened or closed, thus reducing the risk of spillage or contamination of the operator or of the environment.

The object is achieved by carrying the substance in a small glass or plastics vial which is itself contained in a larger container, preferably made of plastics material, which has a screw top lid. The lid is cylindrical and has its two ends hollowed out to form first and second engagement means respectively. The first of said engagement means comprises a screw thread which is engageable with a corresponding thread on the body of the container so that the body of the container, which contains the vial, can be closed in the conventional manner. The second of said engagement means is shaped to engage the removable top of the vial itself so that the top of the vial can be released by manipulating the lid of the container. Preferably the top of the vial is also a screw top.

In an embodiment of the invention, the exterior surface of the vial screw top is part serrated and said second engagement means on the container lid is such as to engage said serrated surface so that, upon rotation of the container lid, the vial top will be unscrewed.

It will be seen that the contents of the vial can be reached by first rotating the container lid to remove same, thence turning the container lid over and engaging it on the vial top, whereupon the vial top may be unscrewed in comparative safety by rotating the container lid.

Preferably said second engagement means on the lid is operable not only to enable the lid to be used to rotate the vial top, but is further operable to engage the vial top in such a way that, once unscrewed, the vial top may be removed as a unit with the lid.

In an embodiment of the invention, the container system additionally comprises a tray, the surface of which is formed with a first tray engagement means engageable with an engagement means on the underside of the container and a second tray engagement means engageable with one of said engagement means on the container lid.

As mentioned above, the substance to be carried is contained in a small container, for example a glass or plastics vial, within the main container. However, it is possible that the inner container may be constructed as part of the outer. The top of the vial may also be perforatable, so as to permit part removal of the contents by means of a hypodermic syringe, or similar without actually removing the vial cap.

In the event that radioactive substances are to be carried, the container may be sheathed with or have moulded to it screening material such as lead or steel.

The invention also provides a method of opening a vial, which vial is housed within or forms part of a container, said method comprising unscrewing a screw top lid of said container until released, thence engaging said lid with a top of the vial, and releasing the vial top by manipulation of the container lid.

In a preferred method, the container is first placed on a tray such that the container is frictionally engaged by an engaging means on the tray, then the lid is removed from the container and is placed on the tray in such a manner that it is frictionally engaged by a further engaging means on the tray. Preferably, after the lid has been removed from the container, one of said engagement means on the lid is frictionally engaged with the top of the vial which may thence be unscrewed and removed as a unit without touching the top. Finally, both the lid and the top are placed on the tray in such a manner that the lid is frictionally engaged by the other of said engaging means on the tray.

BRIEF DESCRIPTION OF THE DRAWINGS

In order that the invention may be better understood, an embodiment thereof will now be described by way of example only and with reference to the accompanying drawings in which:

FIG. 1 is a general perspective view of an embodiment of a container system according to the invention;

FIG. 2 is an underside view of the container forming part of the system of FIG. 1;

FIG. 3 is a plan view of the tray forming part of the system of FIG. 1; and FIGS. 4, 5 and 6 are perspective views showing various different stages in the operation of the system of FIG. 1.

DETAILED DESCRIPTION OF THE PREFERRED EMBODIMENTS

Figures 5, 6:
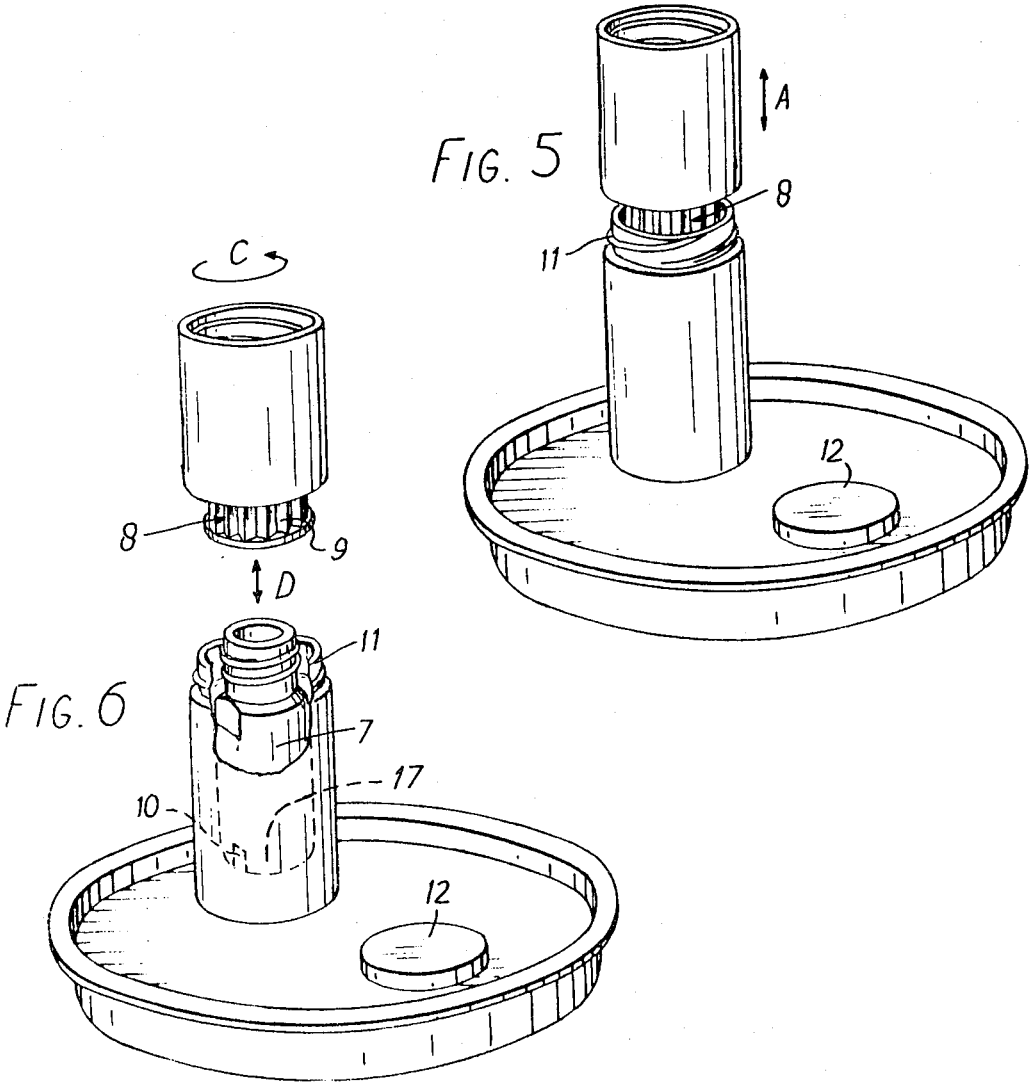

Referring firstly to FIGS. 1, 2 and 3 the container system comprises a cylindrical container 1 of ABS plastics material having a lid 2, also of ABS plastics material and of similar external shape. The underneath surface 3 of the container 1 is formed with a short blind bore or recess 4 of a polygonal section which is a friction fit over a correspondingly-shaped projection or pillar 5 on the upper surface of a circular tray 6. FIG. 1 shows the container in position on the tray 6.

Referring now to all the drawings, it will be seen that the container 1 itself contains a smaller container, in the form of a vial 7 having a screw-top 8 which has a serrated external surface 9. The vial is made of glass, or plastics, or plastics lined with glass, depending upon the substance being carried. In the event that radioactive substances are to be carried a steel tube may be moulded inside the cylindrical wall of container 1 in order to provide protection from small or moderate radiation levels. The vial 7, while being readily removable, is a friction fit within container 1 in order to prevent its rotation within the container when the top is unscrewed, and also to ensure that the vial does not drop out if the container is accidentally inverted. If desired, the bottom of the vial may be provided with a cut-out portion or axially inwardly extending groove 10 which engages a corresponding lug (not shown) on the inside of the container, thus providing a positive lock against rotation. Preferably the bottom of the vial may be formed as a semi-resilient skirt which tends to keep the vial such that the cutout portion 10 and its corresponding lug do not engage until downwards pressure is applied to the vial, thus pushing the vial into the bottom of the container.

The lid 2 is cylindrical in shape, and has blind bores at both ends. At the bottom end (as seen in FIG. 1) the bore is internally threaded to engage a corresponding external thread 11 on the container 1. The upper surface of the tray 6 is formed with a further projection 12, of circular section, which is of such size as to be a friction fit within the threaded bore of the lid 2. This enables the lid to be secured on the tray, once the container has been opened, as will be explained below.

The top surface 13 of the lid 2 is formed with a blind bore or cavity 14 which is generally circular in section, but has four equiangularly-spaced triangular projections 15 extending therefrom, as shown best in FIG. 4. These projections 15 are such as to be engageable with the serrated external surface 9 of the top 8 of the vial, as will be explained in more detail hereinafter.

In order to explain how the container is used, it is first assumed that the lid is in position on the container, with the vial within. In order to open the container, it is first placed on the tray such that the blind bore 4 frictionally engages the projection 5, as shown in FIG. 1. Next, the lid 2 is unscrewed from container 1 and is raised vertically upwards as shown by the double-headed arrow A in FIG. 5, and is then turned over, as represented by the arrow B in FIG. 4, and is pushed down over the now-projecting screw-top 8 of the vial in such a way that the projections 15 engage the serrated surface 9 of the top. Downwards pressure is now applied to the top 8 so that the vial moves downwards in the container so that the cut-out 10 is able to engage its corresponding lug, and the top is thence unscrewed by rotating the lid 2, as represented by the arrow C in FIG. 6, while maintaining the downwards pressure. The top 8 is then removed by vertical upwards movement, as represented by the double-headed arrow D in FIG. 6. Finally, the lid 2, together with the top 8, are placed on the tray such that the internally screw-threaded bore in the lid 2 frictionally engages the projection 12. The contents of the vial may now be removed using a pipette. Alternatively, subsequent chemical reactions may be performed within the vial itself, by addition of appropriate reagents. Once the contents of the vial have been used the device, preferably (for safety) after having been reassembled, including the tray may be discarded.

It will be seen that the vial can be opened without the danger of the operator becoming contaminated by its contents since, at no time need any part of the vial itself, or its screw top, be touched.

If it is desired to close the vial and container after using a part of the contents, the above described procedure is simply reversed, and it will be noted that there is again little danger of contamination during this procedure. However, it is anticipated that usually, if only part of the contents of the vial are to be removed, a hypodermic syringe applied through a conventional rubber hypodermic entry seal 16 in the screw top 8 will suffice, it then, of course, being unnecessary to remove the top 8.

It has previously been mentioned that the vial is a friction fit within container 1. One way of achieving this, not shown in the drawings, is to provide on the inside cylindrical surface of the container, a shallow ridge extending around the surface adjacent the bottom of the container. This ridge, protruding inwards as it does from the remainder of the inside surface, will engage the skirt portion 17 of the vial and prevent the body of the vial rotating while the top is being unscrewed. Such a ridge could be used in conjunction with a cut-out portion 10 and associated lug, described above, or by itself. In both cases, it is the intention that the vial, in its normal (upper) position within the container will be lightly held therein by friction, but that much greater frictional forces, due to the ridge, or positive locking action, due to the cut-out portion 10 and associated lug, will be brought to bear if the vial is pushed downwards in the container in order to unscrew its top. It will also be found that it is possible, if desired, to completely remove the vial from the container by first applying the container lid 2 to the vial top 8, as described above, and thence rotating the lid in a direction opposite to that for normal unscrewing, whereupon the frictional fit of the vial within the container will be broken, thus allowing the vial to be removed, complete with its top and the container lid.

I claim:

1. A container system comprising:

a container having a body and a removable lid, said body having an externally threaded end, said lid having first and second opposing lid ends, said first lid end having internal threads for allowing said first lid one end to threadably engage said container externally threaded end thereby closing said container;

a vial adapted to fit within said container and having a vessel and a removable top releasably fitted to said vessel;

said second lid end having a first engaging means for, when said lid is removed from said container, engaging the outer periphery of said removable top for releasing said removable top from said vessel by a manipulation of said lid; and a tray having a second engaging means for engaging said container body and removably fixing said container body to said tray and having a third engaging means for, when said lid is removed from said container, engaging said lid and removably fixing said lid to said tray.

2. A container system as claimed in claim 1, wherein said first engaging means is for, when engaging said removable top, gripping the outer periphery of said removable top for allowing it to be removed and lifted upwardly with said removable lid after it is released.

3. A container system as claimed in claims 1 or 2, wherein:

said vessel has an externally threaded portion and said removable top has an internally threaded portion adapted to threadably engage said vessel externally threaded portion thereby closing said vessel;

said lid is cylindrical;

said first lid end has an axially inwardly extending bore and said second lid end has an axially inwardly extending cavity; and said first lid end internal threads being located on the periphery of said bore and the outer periphery of said cavity being shaped to form said first engaging means.

4. A container system as claimed in claim 3, wherein the outer periphery of said removable top is substantially serrated and said first engaging means is for engaging the serrations for releasing and removing said removable top from said vessel.

5. A container system as claimed in claim 1, wherein said vial is adapted to contain radioactive material.

6. A container system as claimed in claim 5, further comprising a shield operatively associated with said container for, when said vial contains radioactive material, shielding a user from radiation emitted by radioactive material contained in said vial.

7. A container system as claimed in claim 6, wherein said shield is a metal screen.

8. A container system as claimed in claim 1 or 5, wherein: said container has a fourth engaging means for engaging said second engaging means, said fourth engaging means being located on the end of said container body opposite said container body externally threaded end, said second and fourth engaging means cooperating with each other for, when said tray engages said container body, nonrotatably fixing said container body to said tray.

9. A container system as claimed in claim 8, wherein said container has a recess, said second engaging means is an outwardly projecting pillar having a polygonal longitudinal cross section, and said fourth engaging means is a correspondingly shaped outer periphery of said recess.

10. A method of opening a vial, having a vessel and a removable top thereon, which is positioned inside a container, having a body and a removable lid threaded therewith, comprising the steps of:

placing the container on a tray and engaging a portion of said container, with a first engaging means on the tray for nonrotatably fixing the container to the tray;

unscrewing the removable lid from the container and removing it therefrom;

engaging the removable top with a second engaging means located on the removable lid and manipulating the removable lid for releasing the removable top from the vessel;

removing the removable top from the vessel by further manipulating the removable lid; and positioning the removable lid on the tray and frictionally engaging a third engaging means located on the removable lid with a fourth engaging means located on the tray for removably fixing the removable lid to the tray.

* * * * *